US007549624B2

(12) United States Patent
Watanabe

(10) Patent No.: US 7,549,624 B2
(45) Date of Patent: Jun. 23, 2009

(54) SHEET SUPPLYING APPARATUS

(75) Inventor: Yusaku Watanabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 445 days.

(21) Appl. No.: 11/534,665

(22) Filed: Sep. 24, 2006

(65) Prior Publication Data

US 2007/0069447 A1 Mar. 29, 2007

(30) Foreign Application Priority Data

Sep. 29, 2005 (JP) ..... 2005-285126

(51) Int. Cl.
*B65H 3/44* (2006.01)
*B65H 3/34* (2006.01)

(52) U.S. Cl. ..... 271/9.11; 271/167; 271/121; 271/9.07

(58) Field of Classification Search ..... 271/9.11, 271/167, 121, 9.13, 9.07
See application file for complete search history.

(56) References Cited

U.S. PATENT DOCUMENTS

| | | | | |
|---|---|---|---|---|
| 6,908,081 | B2 | 6/2005 | Takito et al. | |
| 7,000,916 | B2 | 2/2006 | Asada et al. | |
| 7,014,186 | B2 | 3/2006 | Shiohara et al. | |
| 7,434,800 | B2 * | 10/2008 | Asada et al. | 271/121 |
| 2004/0032077 | A1 * | 2/2004 | Oh et al. | 271/121 |
| 2004/0084831 | A1 | 5/2004 | Asada | |
| 2006/0163796 | A1 | 7/2006 | Shiohara et al. | |
| 2006/0164501 | A1 | 7/2006 | Koga | |

(Continued)

FOREIGN PATENT DOCUMENTS

JP H04-246031 A 9/1992

(Continued)

OTHER PUBLICATIONS

European Patent Office, European Search Report for Related Application No. 06019903.1, dated Jan. 11, 2007.

*Primary Examiner*—Patrick H Mackey
*Assistant Examiner*—Luis Gonzalez
(74) *Attorney, Agent, or Firm*—Baker Botts L.L.P.

(57) ABSTRACT

A sheet supplying apparatus including first and second sheet accommodating portions; at least one supplying member which supplies recording sheets from the accommodating portions; a separating device which cooperates with the supplying member to separate the recording sheets from each other, and which includes (A) an inclined guide plate opposed to respective leading ends of the recording sheets and (B) a sheet-separate body including sheet-separate portions arranged in an array along a sheet-supply path so as to project from the inclined guide plate toward the recording sheets; and at least one contact preventing portion which projects toward the recording sheets, beyond respective free ends of the sheet-separate portions, and which is provided at a position corresponding to an intermediate portion of the array of sheet-separate portions with respect to the sheet-supply path, and assuring that the contact preventing portion prevents each of the recording sheets supplied from the first accommodating portion, from contacting at least one sheet-separate portion of a downstream portion of the array of sheet-separate portions located on a downstream side of the contact preventing portion with respect to the sheet-supply path, and allows each of the recording sheets supplied from the second accommodating portion to contact the downstream portion of the array of sheet-separate portions.

15 Claims, 11 Drawing Sheets

U.S. PATENT DOCUMENTS

2006/0180992 A1 8/2006 Asada
2007/0132172 A1* 6/2007 Mo ..... 271/121

FOREIGN PATENT DOCUMENTS

JP H11 59925 3/1999
JP 2002-338070 A 11/2002
JP 2003 285948 10/2003
JP 2003 285949 10/2003
JP 2004 051336 2/2004
JP 2004 149297 5/2004
JP 2006 182481 7/2006

* cited by examiner

SHEET SUPPLYING APPARATUS

The present application is based on Japanese Patent Application No. 2005-285126 filed on Sep. 29, 2005, the contents of which are incorporated herein by reference.

BACKGROUND OF THE INVENTION

1. Field of the Invention

The present invention relates to a sheet supplying apparatus that supplies a plurality of recording sheets, one by one, while separating the recording sheets from each other.

2. Discussion of Related Art

Generally, a conventional image recording device, such as a printer or a facsimile machine, includes an image recording portion and a sheet-supply cassette that accommodates a plurality of stacked recording sheets each as a recording medium, and supplies the recording sheets, one by one, from the sheet-supply cassette to the image recording portion so that the image recording portion may record an image on each recording sheet. For example, Patent Document 1 (i.e., Japanese Patent Application Publication No. 2004-149297 or its corresponding U.S. Patent Application Publication No. 2004-084831 A1) discloses a sheet supplying device including a sheet accommodating portion that accommodates a plurality of stacked recording sheets in their inclined postures; a sheet-supply roller that is pressed on the uppermost one of the stacked recording sheets; and a sheet separating portion that is supported by a bottom plate such that respective lower (i.e., leading) ends of the stacked recording sheets are held in contact with the sheet separating portion. The sheet separating portion includes a plurality of projecting portions that are arranged at regular intervals of distance, along a sheet-supply path along which each recording sheet is supplied; a plurality of pairs of arm portions each pair of which supports a corresponding one of the projecting portions, on either side of the one projecting portion; and a continuous base portion that continuously connects the arm portions to each other and thereby supports the arm portions. The sheet separating portion is held by a holder that is formed of a metallic plate and is fixed to the bottom plate, such that the projecting portions project by respective predetermined amounts through an elongate hole of the holder that is elongate along the sheet-supply path. When the sheet-supply roller, pressed on the uppermost one of the stacked recording sheets, is driven or rotated to convey the uppermost recording sheet, the leading end of the uppermost recording sheet pushes an appropriate one of the projecting portions, and consequently the one projecting portion is moved downward into the elongate hole of the holder because of elastic deformation of the corresponding arm portion. Since, however, the other recording sheets than the uppermost recording sheet are not moved because the respective leading ends thereof are engaged with the other projecting portions that remain projecting from the elongate hole, only the uppermost recording sheet is separated from the other recording sheets and is conveyed forward.

Meanwhile, recently, there is known an image recording device including a housing and a plurality of sheet-supply cassettes that accommodate different sorts of recording sheets, respectively, and that are insertable into, and removable from, the housing. For example, Patent Document 2 (i.e., Japanese Patent Application Publication No. 11-59925) discloses a sheet supplying device including a first box-like sheet-supply cassette and a second plate-like sheet-supply cassette that is detachably attached to a top portion of the first cassette and that accommodates a plurality of recording sheets whose size is smaller than that of the recording sheets accommodated by the first cassette. When the first sheet-supply cassette is used, the second sheet-supply cassette is detached from the first cassette, so that only the first cassette is inserted into the housing. On the other hand, when the second sheet-supply cassette is used, the second cassette is attached to the first sheet-supply cassette, so that the second cassette with the first cassette is inserted into the housing. In the state in which the second cassette with the first cassette is set in the housing, a sheet-supply roller is pressed on the uppermost one of the recording sheets accommodated by the second cassette, so as to supply the uppermost recording sheet to an image recording portion; and in the state in which only the first cassette is set in the housing, the sheet-supply roller is pressed on the uppermost one of the recording sheets accommodated by the first cassette, so as to supply the uppermost recording sheet to the image recording portion. The first sheet-supply cassette has, in an end wall thereof an outlet opening that is commonly used to supply the recording sheets from both the first and second sheet-supply cassettes.

However, the sheet supplying device disclosed by Patent Document 2 does not. employ a sheet separating portion as disclosed by Patent Document 1 in such a manner that the sheet separating portion is applied to the outlet opening of the first sheet-supply cassette and is commonly used to separate, from each other, the recording sheets supplied from each of the first and second sheet-supply cassettes Thus, the conventional sheet supplying device does not meet two requirements, i.e., the decreasing of size of the device as a whole and the increasing of accuracy of the supplying of recording sheets.

SUMMARY OF THE INVENTION

In the above-described technical background, the present invention has been developed It is therefore an object of the present invention to solve at least one of the above-indicated problems. It is another object of the present invention to provide a sheet supplying apparatus that employs a plurality of sheet accommodating portions each of which accommodates a plurality of stacked recording sheets and that supplies, from each of the two sheet accommodating portions, the recording sheets while separating the sheets from each other. It is another object of the present invention to provide a sheet supplying apparatus that enjoys a simplified construction and/or a decreased production cost.

According to the present invention, there is provided a sheet supplying apparatus for supplying a plurality of recording sheets, one by one, along a sheet-supply path, the apparatus comprising a first accommodating portion which has a first supporting surface, which accommodates a plurality of first recording sheets stacked on each other on the first supporting surface, and from which the first recording sheets are supplied, one by one, along the sheet-supply path; a second accommodating portion which has a second supporting surface, which accommodates a plurality of second recording sheets stacked on each other on the second supporting surface, and from which the second recording sheets are supplied, one by one, along the sheet-supply path; at least one supplying member which contacts an uppermost one of the first recording sheets accommodated by the first accommodating portion, so as to supply the uppermost first recording sheet from the first accommodating portion, and additionally contacts an uppermost one of the second recording sheets accommodated by the second accommodating portion, so as to supply the uppermost second recording sheet from the second accommodating portion; a separating device which cooperates with the at least one supplying member to separate the first recording sheets from each other and separate the second recording sheets from each other, wherein the separating device includes (A) an inclined guide plate which is provided at an upstream-side end portion of the sheet-supply path such that the inclined guide plate extends in a widthwise direction of the sheet-supply path, which is inclined relative to each of the first and second supporting surfaces such that the inclined guide plate is opposed to respective leading ends of respective greatest possible numbers of the first and second recording sheets that can be accommodated by the first and second accommodating portions, and which guides a movement of each of the first and second recording sheets along the sheet-supply path, and (B) a sheet-separate body which is supported by the inclined guide plate and which includes a plurality of sheet-separate portions arranged in at least one array along the sheet-supply path such that the sheet-separate portions project from the inclined guide plate toward the fist and second recording sheets accommodated by the first and second accommodating portions; and at least one contact preventing portion which projects toward the first and second recording sheets, beyond respective free ends of the sheet-separate portions, and which is provided at a position corresponding to an intermediate portion of the at least one array of sheet-separate portions with respect to the sheet-supply path, and assuring that the at least one contact preventing portion prevents each of the first recording sheets supplied from the first accommodating portion, from contacting at least one sheet-separate portion of a downstream portion of the at least one array of sheet-separate portions that is located on a downstream side of the at least one contact preventing portion with respect to the sheet-supply path, and allows each of the second recording sheets supplied from the second accommodating portion, to contact the downstream portion of the at least one array of sheet-separate portions. The present apparatus may comprise, as the at least one supplying member, a single supplying member commonly used with the first and second accommodating portions, or two supplying members that exclusively used with the first and second accommodating portions, respectively.

In the present sheet supplying apparatus, the inclined guide plate and the sheet-separate body are commonly used for supplying the first recording sheets from the first accommodating portion and supplying the second recording sheets from the second accommodating portion. Thus, the first recording sheets accommodated by the first accommodating portion can be supplied while being reliably separated from each other, and the second recording sheets accommodated by the second accommodating portion can be supplied while being reliably separated from each other. In addition, since the inclined guide plate and the sheet-separate body are common the first and second accommodating portions, the present apparatus enjoys a simpler construction and a lower production cost than a case where individual inclined guide plates and individual sheet-separate bodies are provided for the first and second accommodating portions, respectively.

Moreover, if the present sheet supplying apparatus does not employ the contact preventing portion, then the uppermost first recording sheet that has been separated from the other first recording sheets by the sheet-separate portions of the upstream portion of the array of sheet-separate portions with respect to the sheet-supply path, continues to contact the sheet-separate portions of the downstream portion of the array. This leads to increasing the load of conveying the uppermost first recording sheet. For example, a driving force used to drive the supplying member needs to be increased. However, the present apparatus employs the contact preventing portion provided at the position corresponding to the intermediate portion of the array of sheet-separate portions and assuring that the contact preventing portion prevents each of the first recording sheets supplied from the first accommodating portion, from contacting the downstream portion of the array of sheet-separate portions that is located on the downstream side of the contact preventing portion with respect to the sheet-supply path. Thus, each of the first recording sheets accommodated by the first accommodating portion can be supplied without increasing the load of conveying thereof. Consequently, for example, the driving force used to drive the supplying member need not be increased, a capacity or size of a drive source to drive the supplying member need not be increased, or a cost of the drive source need not be increased.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
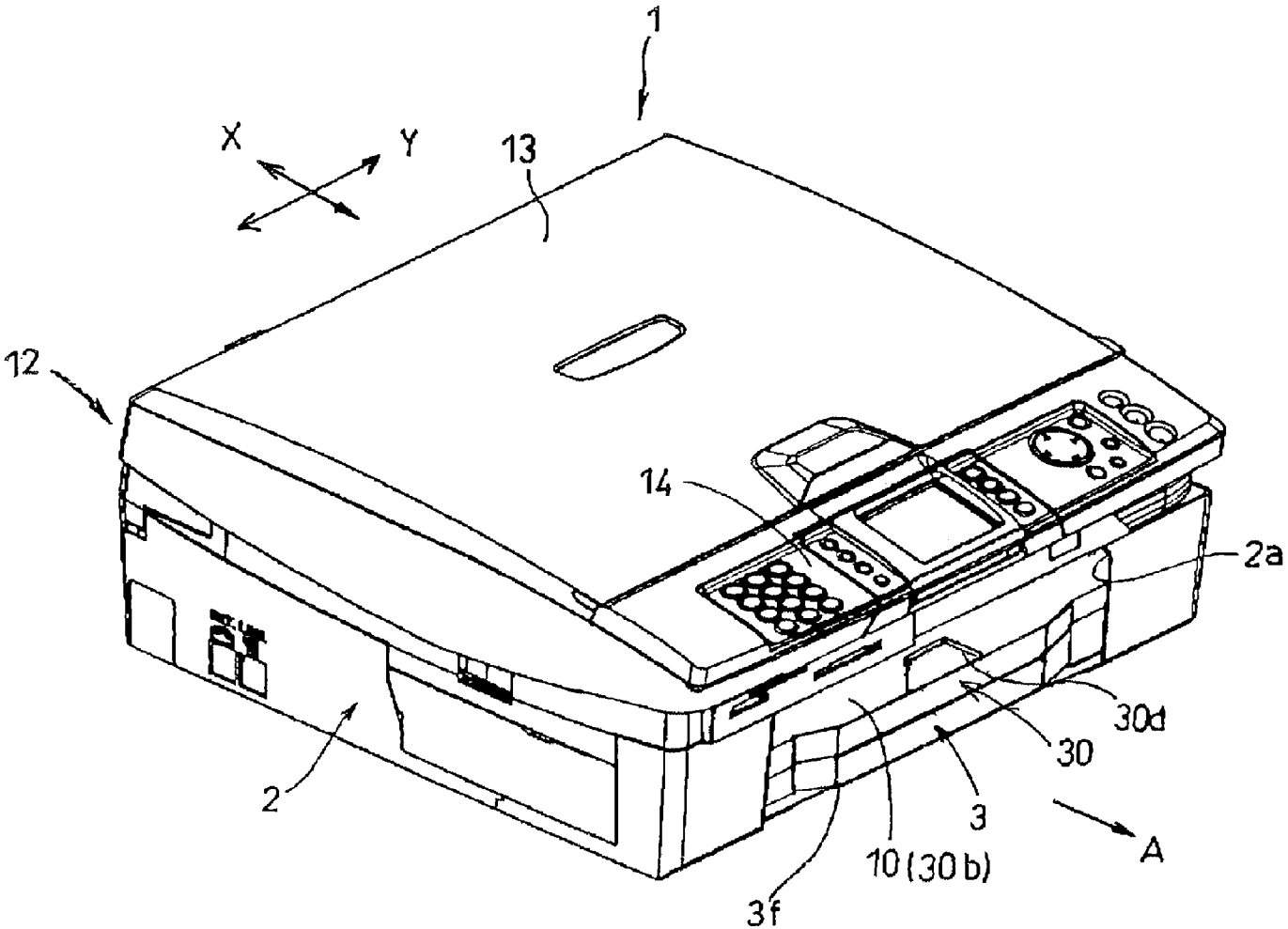
FIG. 1 is a perspective view of an image recording apparatus including a sheet supplying apparatus to which the present invention is applied.
Figure 2:
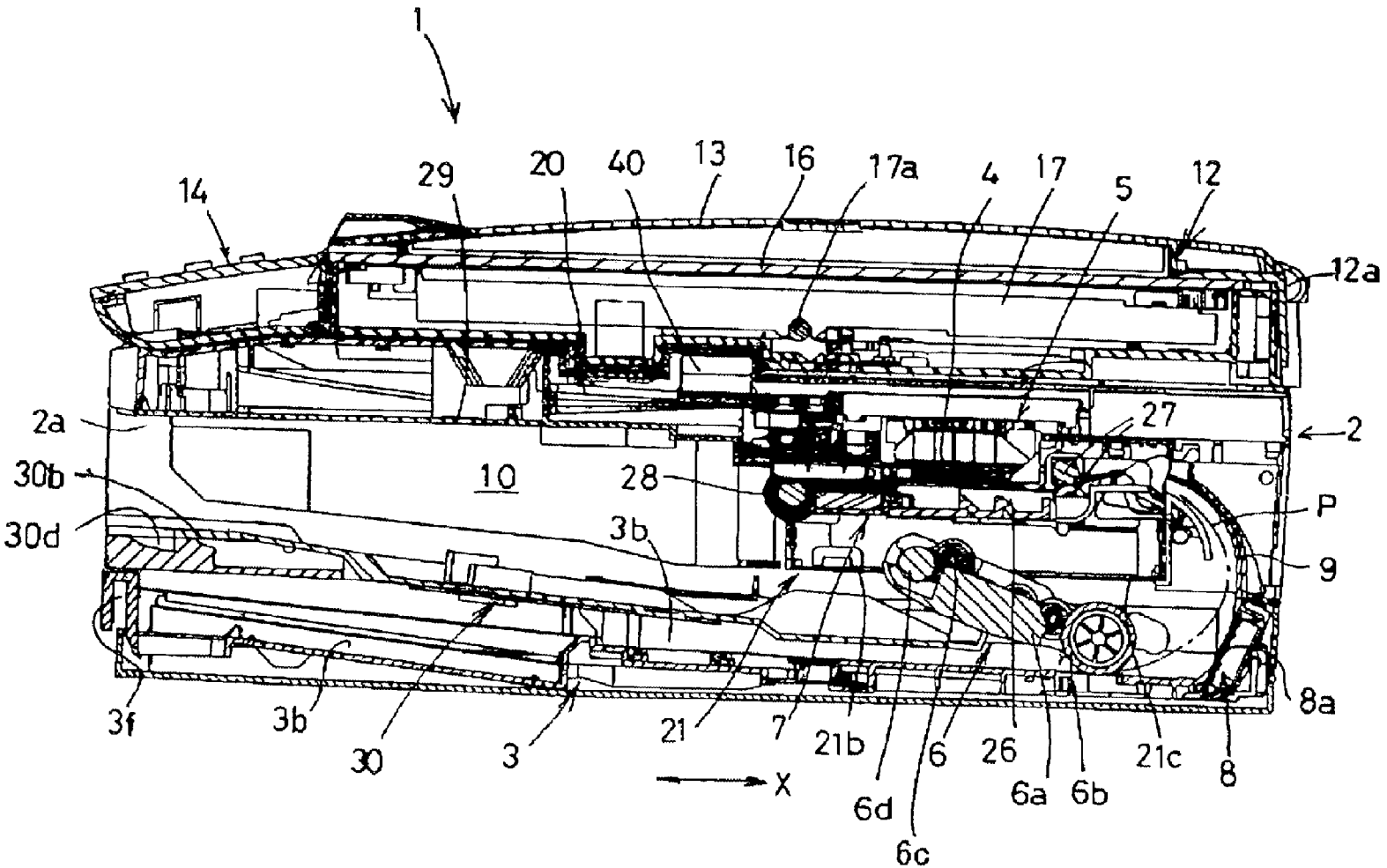
FIG. 2 is a cross-sectional view of the image recording apparatus.

Hereinafter, there will be described a basic embodiment of the present invention by reference to FIGS. 1 through 10 and 11A. The present embodiment relates to a sheet supplying apparatus that is employed by an image recording apparatus 1, i.e., a "multi-function device (MFD)" having a printer function, a copier function, a scanner function, and a facsimile-machine function. As shown in FIGS. 1 and 2, the image recording apparatus 1 includes a housing 2 that is formed by injection molding of a synthetic resin and constitutes a main frame of the recording apparatus 1. In a bottom portion of the housing 2, there is provided a first sheet-supply cassette 3, described later, that is insertable into, and removable from, the housing 2 via a front opening 2*a* thereof A second sheet-supply cassette 30, also described later, is connectable to, or placeable on, a top portion of the first sheet-supply cassette 3, such that the second sheet-supply cassette 30 is advanceable to a sheet-supply position thereof and is retractable to a non-sheet-supply position thereof. In the following description, a portion, a side, or an end of the recording apparatus 1 where the opening 2*a* is provided will be referred to as the "front" portion, side, or end thereof, and a portion, a side, or an end of the apparatus 1 that is opposite to the front portion, side, or end thereof will be referred to as the "rear" portion, side, or end thereof.

In a top portion of the housing 2, there is provided an image reading device 12 that is used for each of the copier function and the facsimile-machine function, i.e., reading an original image from an original sheet. The image reading device 12 is constructed such that the reading device 12 is pivotable about an axis portion, not shown, located along one lateral side of the housing 2, so that the reading device 12 can be opened upward and closed downward. A cover member 13 that can cover the original sheet placed on an upper surface of the image reading device 12, is attached to the reading device 12 such that a rear end of the cover member 13 is pivotable about an axis portion 12*a* located along a rear end of the reading device 12, so that the cover member 13 can be opened upward and closed downward.

In the top portion of the housing 2, an operation panel 14 is provided in front of the image reading device 12. The operation panel 14 includes various sorts of operation keys and a liquid crystal display (LCD). The image reading device 12 includes an original-sheet support glass plate 16 that supports, on an upper surface thereof, the original sheet and can be covered by the cover member 13 that can be opened upward to allow the original sheet to be placed on the glass plate 16. A contact image sensor (CIS) 17 is provided below the support glass plate 16, such that the image sensor 17 can be reciprocated along a guide shaft 17*a* in a main scanning direction, i.e., a Y direction shown in FIG. 1, so as to read the original image from the original sheet. The Y direction is perpendicular to the drawing sheet of FIG. 2.

Below the image reading device 12 and the operation panel 14, there are provided an image recording portion 7, a sheet discharging portion 10, and an ink storing portion 15 (FIG. 3) within respective projected areas of the image reading device 12 and the operation panel 14 that are projected in a vertically downward direction that is perpendicular to the Y direction and also to an X direction perpendicular to the Y direction The ink storing portion 15 is provided on one side of the sheet discharging portion 10.

Figure 3:
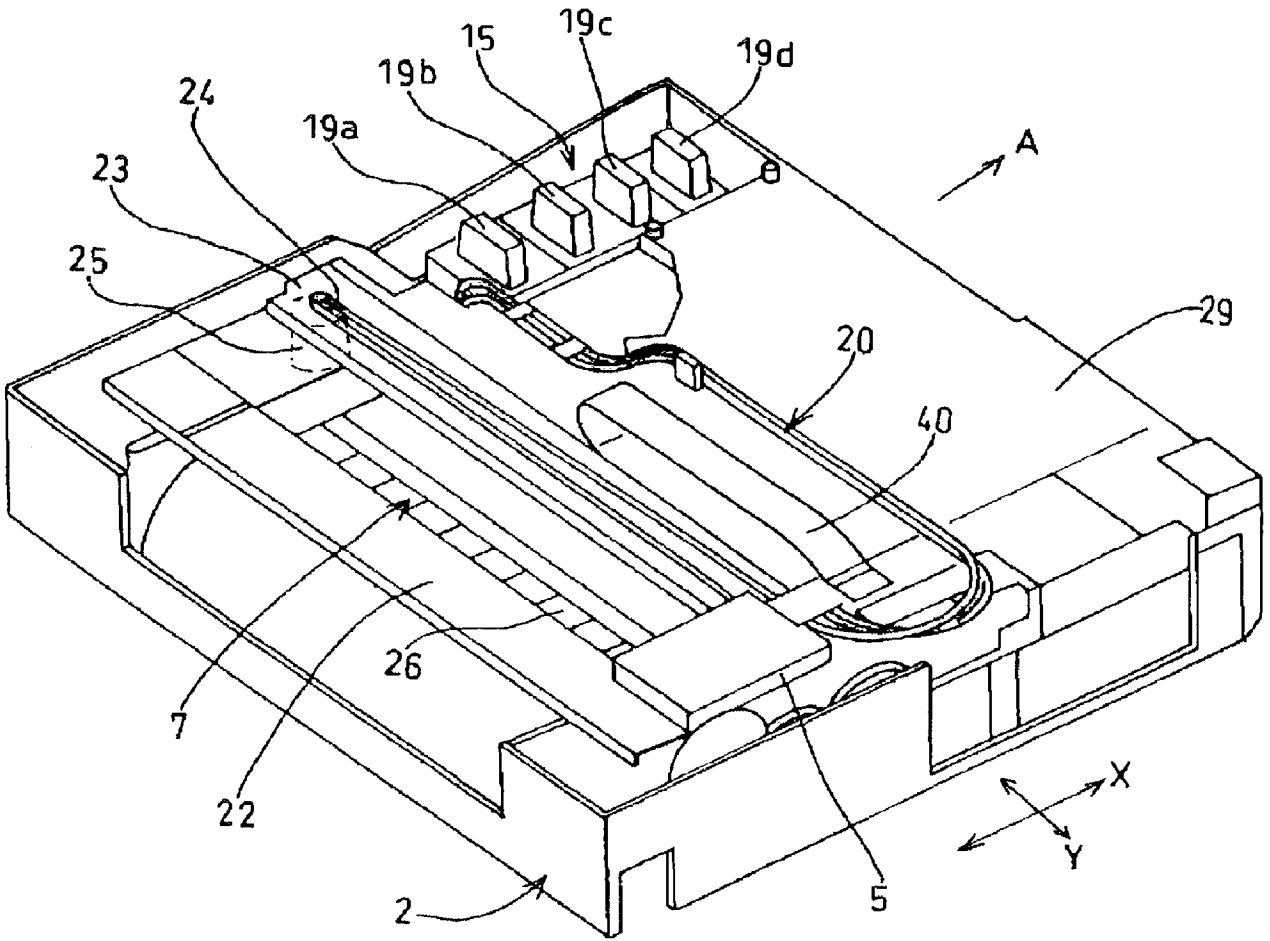
FIG. 3 is a perspective view of a lower portion of the image recording apparatus with an upper portion thereof being removed.

As shown in FIGS. 2 and 3, the image recording device 7 is provided between an upward opening box-like frame 21, and a first and a second elongate plate-like guide member 22, 23 that are respectively supported by two end walls of the box-like frame 21 and extend in the Y direction (.e., the main scanning direction). The first guide member 22 is located on an upstream side of the second guide member 23 in a sheet-convey direction, A. The recording device 7 includes a carriage 5 that carries an ink-jet recording head 4 and bridges the two guide members 22, 23 such that the carriage 5 is slideable or reciprocateable on the same 22, 23.

A timing belt 24 is wound on pulleys fixed to an upper surface of the second guide member 23, located on the downstream side in the sheet-convey direction A, such that the timing belt 24 extends in the main scanning direction (i.e., the Y direction) and is driven to reciprocate the carriage 5. A carriage (CR) motor 25 that drives the timing belt 24 is fixed to a lower surface of the second guide member 23. In the present embodiment, the CR motor 25 is provided by a DC (direct current) motor. However, the DC motor may be replaced with a stepper motor or other sorts of electric motors. The second guide member 23 is provided with a belt-like encoder strip, not shown, that extends in the main scanning direction and detects a current position of the carriage 5 in the same direction. The belt-like encoder strip is disposed such that a detection plane thereof having a plurality of slits arranged at regular intervals in the main scanning direction is vertical.

As shown in FIGS. 2 and 3, a flat platen 26 extends in the Y direction such that the platen 26 is opposed to a lower surface of the recording head 4 mounted on the carriage 5, and the platen 26 is fixed to an upper portion of a bottom plate 21*b* of the box-like frame 21 at a position between the first and second guide members 22, 23.

A partition plate 29 is formed of the synthetic resin, integrally with the housing 2, and is located above the sheet discharging portion 10, at a height position substantially level with the bottom plate 2*a* of the box-like frame 21, such that the partition plate 29 extends from the lower surface of the downstream-side, second guide member 23 to the front opening 2*a* of the housing 2 that also functions as a sheet-discharge outlet.

As shown in FIG. 3, the ink storing portion 15 opens upward through an upper opening of the housing 2, and accommodates four ink cartridges 19 (19*a*, 19*b*, 19*c*, 19*d*) that respectively store four inks, e.g., black (BK), cyan (C), magenta (M), and yellow inks (Y), for the purpose of recording a full-color image. Each of the four ink cartridges 19 has a substantially rectangular parallelepiped shape having a small area in its plan view, and a great height. The four ink cartridges 19 are arranged in an array in the X direction, and each ink cartridge 19 is attachable to, and detachable from, the ink storing portion 15 through the upper opening of the housing 2.

The four ink cartridges 19 are connected to the recording head 4 via respective flexible ink-supply tubes 20, so as to supply the respective inks to the same 4. However; in the case where more than four sorts of inks (e.g., six or eight inks) are used, the ink storing portion 15 is modified to accommodate the corresponding number of ink cartridges 19, and those ink cartridges 19 are connected to the recording head 4 via the corresponding number of flexible ink-supply tubes 20, respectively.

As shown in FIG. 3, respective base end portions of the four flexible ink-supply tubes 20 that are near the corresponding ink cartridges 19 are bundled up with each other, at a position near one end of the ink storing portion 15. Respective intermediate portions of the four flexible ink-supply tubes 20 are supported by a substantially horizontal, upper surface of the partition plate 29, so as to extend in the Y direction from one end (i.e., a left-side end in FIG. 3) of the plate 29 to the opposite end (i.e., a right-side end in FIG. 3) of the same 29. The bundled base end portions of the four ink-supply tubes 20 are arranged, side by side, on the upper surface of the partition plate 29.

The image recording portion 7 additionally includes an ink receiving portion, not shown, and a maintenance unit, not shown, that are provided in respective opposite areas outside or beyond an image recording area corresponding to a width (i.e., a length of a short side) of each recording sheet as a sort of recording medium that is accommodated by the first sheet-supply cassette 3. At a flushing position opposed to the ink receiving portion, the recording head 4 periodically ejects or "flushes" droplets of inks during an image recording operation, for the purpose of preventing clogging of ink-ejection nozzles of the recording head 4, and the ink receiving portion receives the droplets of inks ejected by the nozzles of the head 4. At a waiting position opposed to the maintenance unit, a capping portion of the maintenance unit covers the lower surface (i.e., nozzle-support surface) of the recording head 4 so as to suck an arbitrarily selected one of the different inks. In addition, the maintenance unit carries out a recovering operation to remove air bubbles from a buffer tank, not shown, of the recording head 4. When the carriage 5 is moved in the Y direction along the maintenance unit, a cleaner (e.g., a wiper blade) of the maintenance unit wipes and cleans the nozzle-support surface of the recording head 4.

The recording head 4 mounted on the carriage 5 ejects, from arbitrarily selected ones of the ink-ejection nozzles thereof, droplets of inks in response to command signals supplied thereto from a control portion, not shown, that is supported by the housing 2 at a position distant from the carriage 5. As shown in FIG. 3, a flexible flat cable 40 that transmits the command signals from the control portion to the recording head 4, is provided such that the flexible flat cable 40 extends substantially parallel to the flexible ink-supply tubes 20, in a movement area in which the tubes 20 are moved when the carriage 5 is reciprocated in the main scanning direction.

As shown in FIG. 2, on an upstream side of the platen 26 in the sheet-convey direction A, there are provided a pair of resister (conveyor) rollers 27 that cooperate with each other to convey each recording sheet to an upper surface of the platen 26; and on a downstream side of the platen 26, there are provided a sheet-discharge roller 28 and a spur roller, not shown, that cooperate with each other to convey each recording sheet on which an image has been recorded, to the sheet discharging portion 10.

Next, a construction of the sheet supplying apparatus will be described. In the present embodiment, the sheet supplying apparatus includes two sheet-supply cassettes, i.e., the first and second sheet-supply cassettes 3, 30 shown in FIGS. 4, 5, and 6. The first sheet-supply cassette 3 as a first accommodating portion has a bottom surface 3*b* that supports many recording sheets P stacked on each other. A sheet-supply unit 6 supplies, from the first sheet-supply cassette 3, the recording sheets P, one by one, to the image recording portion 7. In addition, the second sheet-supply cassette 30 is provided above the bottom surface 3*b* of the first sheet-supply cassette 3, such that the second sheet-supply cassette 30 is advanceable and retractable relative to the first sheet-supply cassette 3. The second sheet-supply cassette 30 as a second accommodating portion has a bottom surface 30*a* that supports many recording sheets P1 (FIG. 9) that are stacked on each other and that have a size smaller than that of the recording sheets P accommodated by the first sheet-supply cassette 3.

As shown in FIG. 2, the sheet-supply unit 6 includes a drive axis member 6*d* that is rotatably supported by the two end plates (not shown) of the box-like frame 21 and a pair of axis-member support plates, not shown. One end portion of the drive axis member 6*d* is inserted in a base end portion of a sheet-supply arm 6*a* of the sheet-supply unit 6, such that the one end portion of the member 6*d* projects laterally from the arm 6*a*. When the drive axis member 6*d* is driven or rotated by an electric motor, not shown, under control of the above-described control portion (not shown), a sheet-supply roller 6*b* as a common supplying member is rotated in a forward direction (i.e., counterclockwise in FIG. 2) via a gear transmission device 6*c* provided in the sheet-supply arm 6*a*. In addition, a biasing means (e.g., a torsion coil spring), not shown, biases the sheet-supply arm 6*a* in a downward direction.

Figure 4:
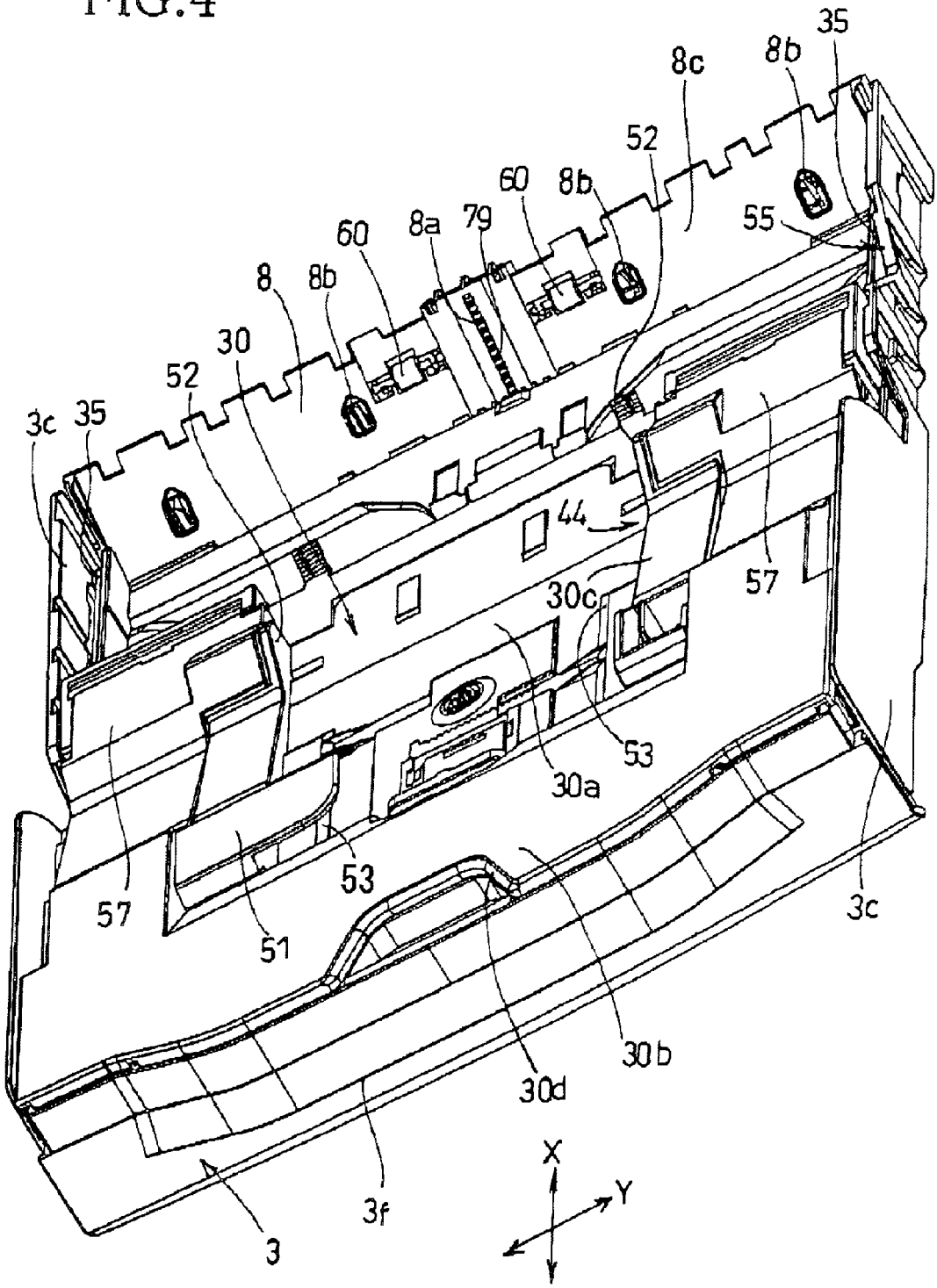
FIG. 4 is a perspective view of a first sheet-supply cassette of the image recording apparatus with a second sheet-supply cassette thereof being positioned at its retracted position, i.e., non-sheet-supply position.
Figure 5:
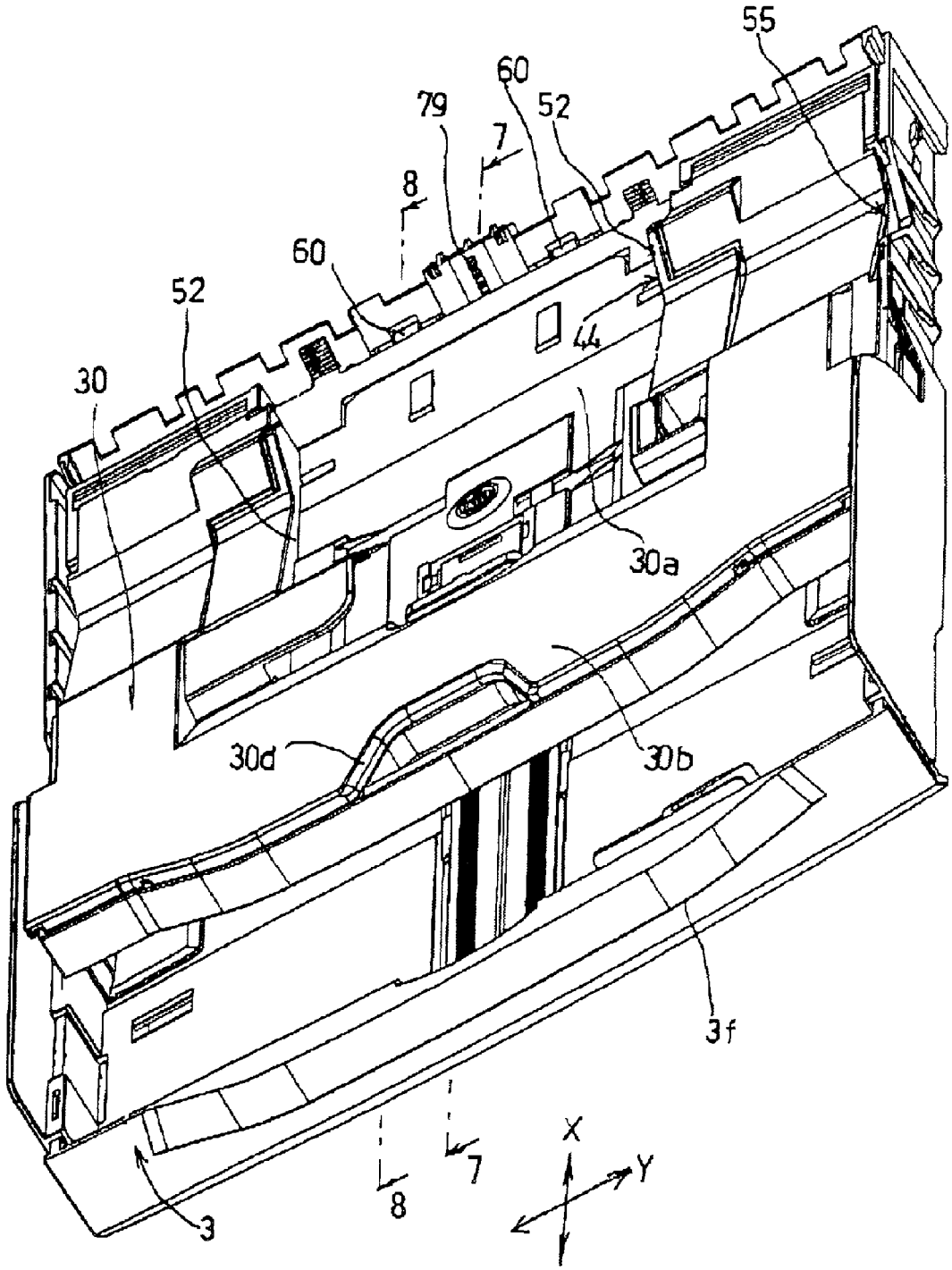
FIG. 5 is a perspective view of the first sheet-supply cassette with the second sheet-supply cassette being positioned at its advanced position, i.e., sheet-supply position.

The sheet-supply roller 6*b* of the sheet-supply unit 6 is constructed such that when the second sheet-supply cassette 30 takes the retracted or non-sheet-supply position, shown in FIG. 4, away from a sheet-supply path 9, the sheet-supply roller 6*b* contacts an upper surface of the uppermost one of the recording sheets P (not shown in FIG. 4) accommodated by the first sheet-supply cassette 3 and, when the second sheet-supply cassette 30 takes the advanced, sheet-supply position, shown in FIG. 5, near the sheet-supply path 9, the sheet-supply roller 6*b* contacts an upper surface of the uppermost one of the recording sheets P1 (not shown in FIG. 5) accommodated by the second sheet-supply cassette 30.

The first sheet-supply cassette 3 can accommodate a large number of recording sheets P cut to have a large size such as A4 size, letter size, or legal size, such that the recording sheets P are stacked on each other on the bottom surface 3*b* thereof as a supporting surface and such that respective short sizes thereof extend in the main scanning direction. The first sheet-supply cassette 3 can accommodate, at the most, about one hundred plain sheets P having an about 10 mm height. The first sheet-supply cassette 3 has, in a front end portion thereof, a handle 3*f* that can be easily operated by fingers of a user when the first sheet-supply cassette 3 is inserted into, and removed from, the housing 2 via the front opening 2*a* thereof.

Figure 6:
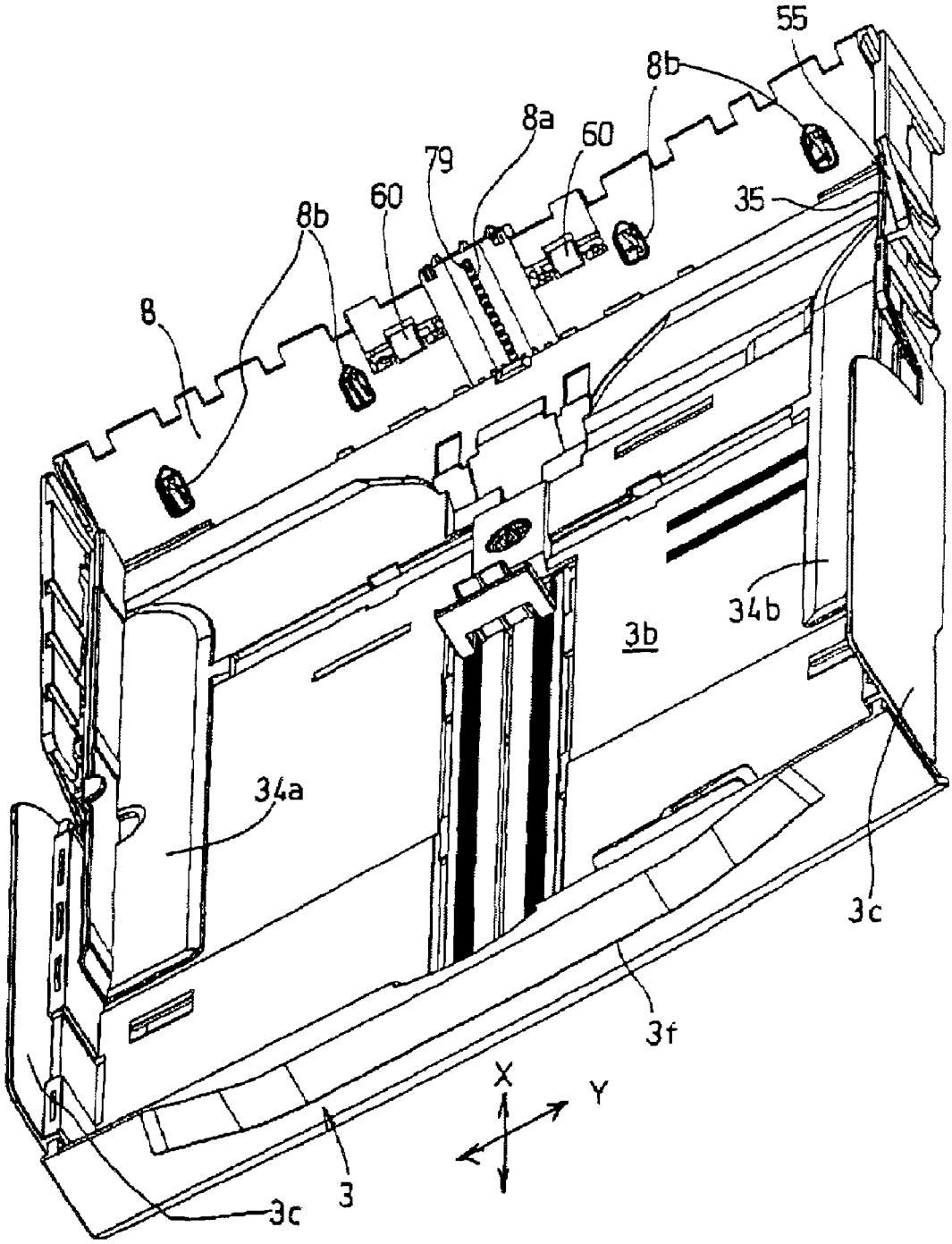
FIG. 6 is a perspective view of the first sheet-supply cassette with the second sheet-supply cassette being removed.
Figure 7:
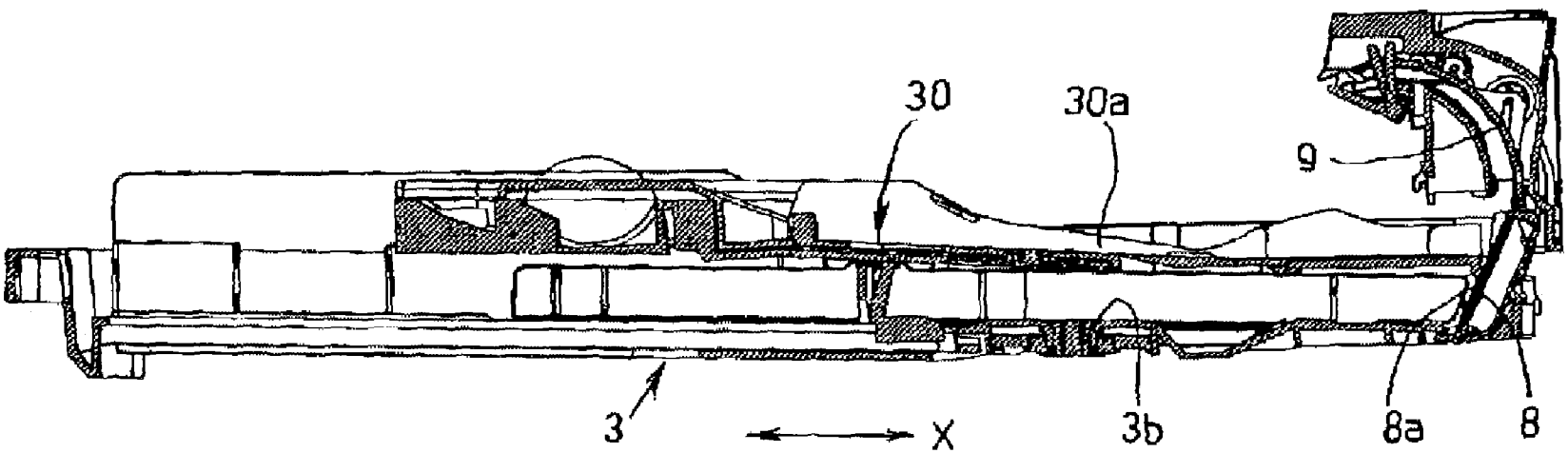
FIG. 7 is a cross-section view of the first sheet-supply cassette, taken along 7-7 in FIG. 5.
Figure 8:
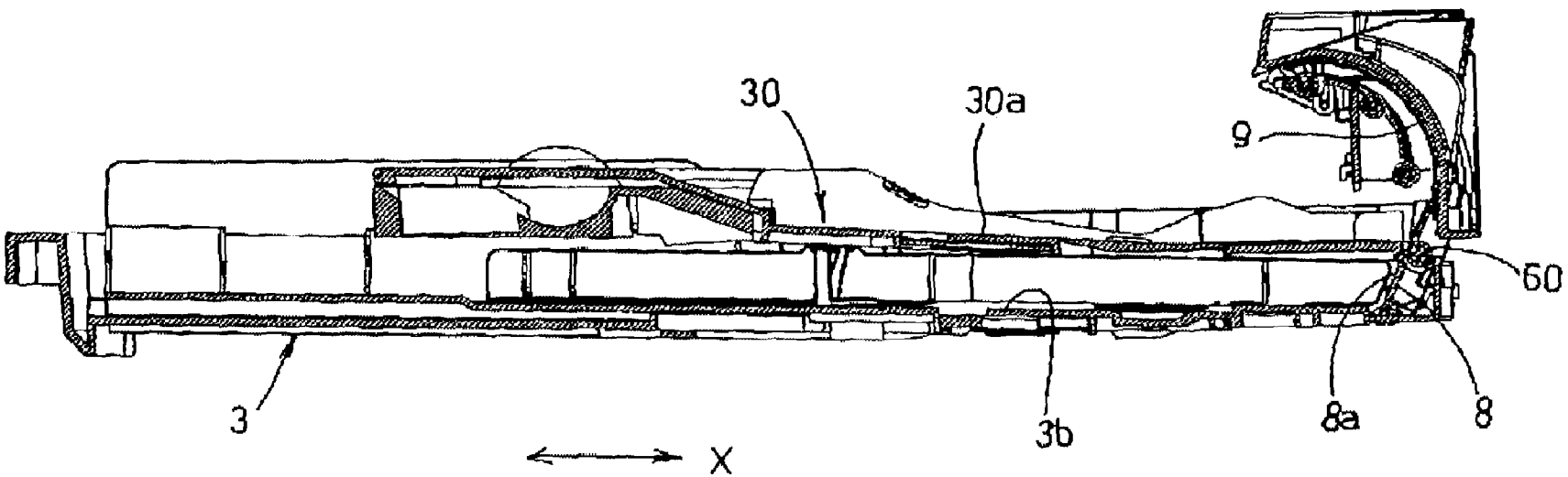
FIG. 8 is another cross-section view of the first sheet-supply cassette, taken along 8-8 in FIG. 5.

As shown in FIG. 6, the first sheet-supply cassette 3 is provided with a guide device including a left-side and a right-side guide member 34*a*, 34*b* that cooperate with each other to guide and position opposite long sides of each of the recording sheets P that extend parallel to the sheet-supply path 9. The left-side and right-side guide members 34*a*, 34*b* are movable or slideable relative to the bottom surface 3*b* in the Y direction, i.e., in a widthwise direction of the sheet-supply path 9, so as to adjust, i.e., increase or decrease a distance between the two members 34*a*, 34*b* and thereby position each recording sheet P in the Y direction. The two guide members 34*a*, 34*b* have respective racks, not shown, that are fixed to respective lower surfaces thereof, and the first sheet-supply cassette 3 has a pinion, not shown, that is rotatably supported by a lower surface of the bottom plate thereof at a center position in the Y direction. The respective racks of the two guide members 34*a*, 34*b* are meshed with the pinion such that the two guide members 34*a*, 34*b* cooperate with each other to center each recording sheet P with respect to the Y direction, i.e., cause a centerline of each recording sheet P with respect to the Y direction to coincide with a centerline of the first sheet-supply cassette 3 in the same direction.

The first sheet-supply cassette 3 has, in a rear end portion thereof (i.e., a right-side end portion thereof in FIG. 2), an inclined sheet-separate (or guide) plate 8 for separating each one of the recording sheets P from the other recording sheets P, and separating each one of the recording sheets P1 from the other recording sheets P1. As shown in FIGS. 4 through 6, the inclined sheet-separate plate 8 supports, in a middle portion thereof in the Y direction, a sheet-separate body 8*a* that cooperates with the sheet-supply roller 6*a* provided at the lower end of the sheet-supply arm 6 to convey each one of the recording sheets P stacked in the first sheet-supply cassette 3 while separating the each one sheet P from the other sheets P, and convey each one of the recording sheets P1 stacked in the second sheet-supply cassette 30 while separating the each one sheet P1 from the other sheets P1. The thus separated recording sheet P or P1 is conveyed to the image recording portion 7 provided above the first and second sheet-supply cassettes 3, 30, via a curved guide member that partly defines a generally U-shaped portion of the sheet-convey path 9 and that is curved obliquely upward and frontward. A lower end of the curved guide member is located adjacent to an upper end of the inclined sheet-separate plate 8 or the sheet-separate body 8*a*. The recording sheet P or P1 on the upper surface of which images have been recorded by the image recording portion 7 is conveyed to the sheet discharging portion 10 communicating with the front opening 2*a*. The inclined sheet-separate plate 8 sheet-separate body 8*a* will be described in detail, later.

As shown in FIGS. 4 and 5, the bottom surface 30*a* of the second sheet-supply cassette 30 is defined by a bottom plate of the cassette 30. The bottom surface 30*a* as a supporting surface supports a large number of stacked recording sheets P1 having a smaller size (e.g., postcard size or photograph-L size) than that of the recording sheets P stacked in the first sheet-supply cassette 3. The recording sheets P1 having the smaller size may be of a different sort (e.g., sheets for exclusive use with ink-jet printers, or glossy sheets for use as photographs) than that of the recording sheets P stacked in the first cassette 3. The bottom surface 30*a* is provided with a guide device 53 (i.e., two guide members) that positions the recording sheets P1 such that a centerline of each recording sheet P1 is aligned with a centerline of the sheet-supply path 9.

The second sheet-supply cassette 30 is provided with a pivotable portion 51 that is pivotally connected to a rear end portion of the second cassette 30 via two hinge portions 52 such that the pivotable portion 51 is pivotable upward when new recording sheets P are inserted into the first sheet-supply cassette 3. More specifically described, in the state in which the pivotable portion 51 is held at the upward pivoted position, a front-side portion of the bottom surface 30*a* is opened more widely than a rear-side portion of the same 30*a*, so that the first sheet-supply cassette 3 is opened upward and the new recording sheets P can be easily inserted into the first cassette 3 through a front-side portion thereof.

The second sheet-supply cassette 30 additionally includes a discharged-sheet receiving portion 30*b* that has a large width substantially equal to that of the first sheet-supply cassette 3 and that is integrally connected to a front end of the second cassette 30. In the case where recording sheets P having a large size are stacked in the first sheet-supply cassette 3 and are used to record images thereon, the front-side portion (i.e., the discharged-sheet receiving portion 30*b*) of the second sheet-supply cassette 30, positioned at the non-sheet-supply position thereof can entirely receive the large-size sheets P on which the images have been recorded.

The second sheet-supply cassette 30 additionally includes two wing portions 57 that integrally project from the rear-side portion of the second cassette 30 in opposite directions, respectively, that are parallel to the Y direction, toward opposite side plates 3*c*, 3*c* of the first sheet-supply cassette 3. The two side plates 3*c*, 3*c* have respective guide rails 35, and the two wing portions 57 are slideable along the two guide rails 35, respectively, in the X direction. Since the two wing portions 57 are provided with respective stoppers, not shown, that prevent the wing portions 57 from coming off the corresponding guide rails 35, the second sheet-supply cassette 30 cannot easily come off the first sheet-supply cassette 3.

The second sheet-supply cassette 30 has, at the front end thereof, i.e., the front end of the discharged-sheet receiving portion 30*b*, a recess 30*d* that can be easily handled by the user. By handling the recess 30*d*, the user can easily move or slide the second sheet-supply cassette 30 relative to the first sheet-supply cassette 3, i.e., push (advance) the second cassette 30 to the advanced, sheet-supply position thereof and draw (retract) the second cassette 30 back to the retracted, non-sheet-supply position thereof.

Figure 9:
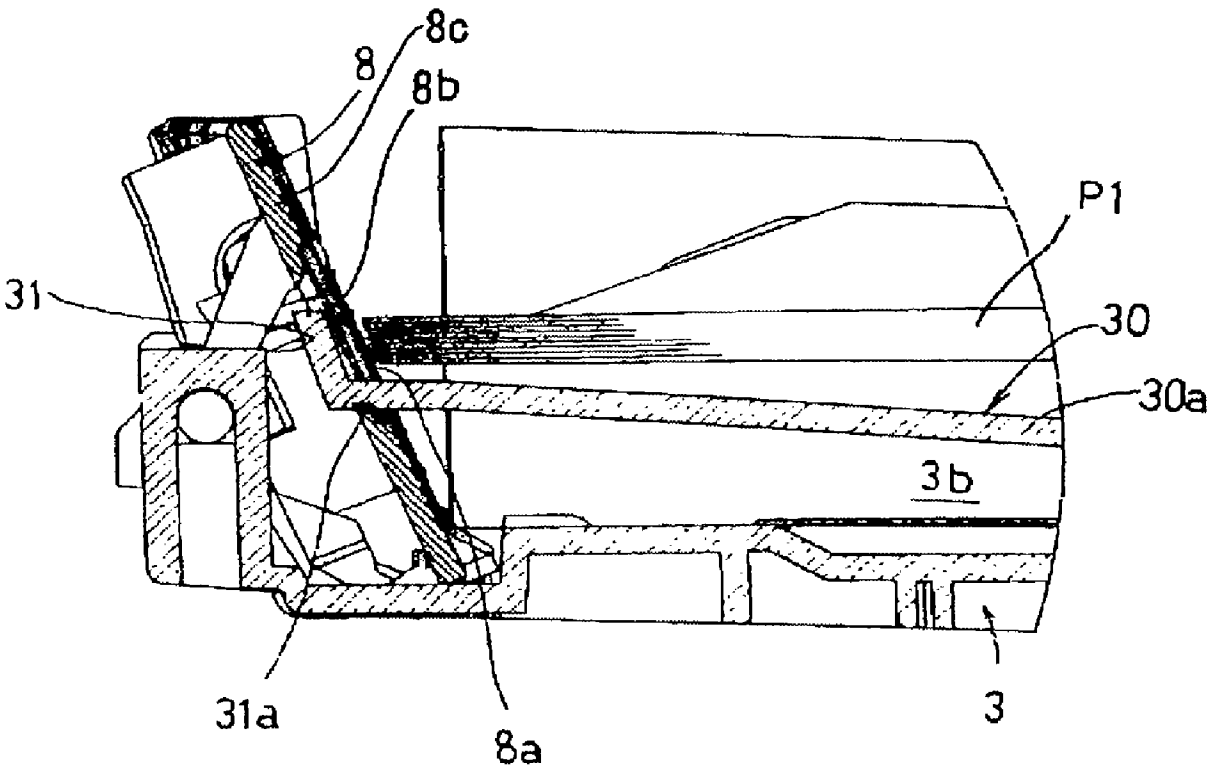
FIG. 9 is a longitudinal cross-section view showing an advanced-position keeping device that keeps the first sheet-supply cassette to the advanced position thereof relative to the second sheet-supply cassette.

Thus, the second sheet-supply cassette 30 is advanceable and retractable relative to the first sheet-supply cassette 3, between the sheet-supply position thereof and the non-sheet-supply position thereof. The second cassette 30 is kept at the sheet-supply position thereof relative to the first cassette 3, by a sheet-supply-position (i.e., advanced-position) keeping device. More specifically described, as shown in FIG. 9, the second sheet-supply cassette 30 has two hook-like engaging portions 31 that project upward from the rear end of the bottom plate defining the bottom surface 30*a*. The two hook-like engaging portions 31 have respective grooves 31*a* formed in respective lower surfaces thereof Meanwhile, as shown in FIG. 6, the inclined sheet-separate plate 8 has plurality of positioning holes 8*b* that are formed through a thickness thereof and are arranged in an array in the Y direction. When the second sheet-supply cassette 30 is pushed toward the advanced, sheet-supply position thereof the two hook-like engaging portions 31 engage the corresponding two positioning holes 8*b*, such that the respective grooves 31*a* of the two engaging portions 31 fit on respective portions of the inclined sheet-separate plate 8 that define respective lower portions of the two positioning holes 8*b*. The sheet-supply-position keeping device includes the two pairs of engaging portions 31 and positioning holes 8*b* that are arranged in the Y direction and are provided on either side of the sheet-separate body 8*a* in the same direction. Thus, the sheet-supply-position keeping device can reliably keep the second sheet-supply cassette 30 to the sheet-supply position thereof, and can prevent the same 30 from being moved out of position relative to the first sheet-supply cassette 3 in the upward or downward direction or the Y direction. However, when the second sheet-supply cassette 30 is retracted toward the non-sheet-supply position thereof by the user, the two hook-like engaging portions 31 can be considerably easily released from the engagement with the corresponding two positioning holes 8*b*.

The sheet-supply arm 6*a* (or the sheet-supply roller 6*b*) of the sheet-supply unit 6 is constructed such that the arm 6*a* is pivoted upward and downward and accordingly the roller 6*b* is moved upward and downward, according to the advancing and retracting movements of each of the first and second sheet-supply cassettes 3, 30. More specifically described, a flat cam-follower member, not shown, integrally projects from the sheet-supply arm 6*a*, such that the cam-follower member extends parallel to the drive axis member 6*d*. The cam-follower member runs over a secondary cam surface 44 that is defined by an upper surface of one 30*c* of opposite side plates of the second sheet-supply cassette 30 and has variable height positions, and further reaches a position where the cam-follower member can engage a main cam surface 55 that is defined by an upper surface of a corresponding one of the opposite side plates 3*c* of the first sheet-supply cassette 3 and has variable height positions When the first and second sheet-supply cassettes 3, 30 are inserted, together with each other, into the housing 2, the cam-follower member of the sheet-supply unit 6 is guided by the main cam surface 55 of the first cassette 3, irrespective of whether the second cassette 30 may be currently positioned at the sheet-supply position thereof or the non-sheet-supply position thereof relative to the first cassette 3 First, the sheet-supply arm 6*a* is pivoted upward to take a substantially horizontal posture and allow the inclined sheet-separate plate 8 to pass below the sheet-supply roller 6*b*, and then the arm 6*a* is pivoted downward to cause the roller 6*b* to contact the uppermost one of the recording sheets P1 stacked on the bottom surface 30*a* of the second sheet-supply cassette 30 or the uppermost one of the recording sheets P stacked on the bottom surface 3*b* of the first sheet-supply cassette 3.

In the state in which the first sheet-supply cassette 3 is set at a sheet-supply position thereof in the housing 2, if the second sheet-supply cassette 30 is advanced from the non-sheet-supply position thereof to the sheet-supply position thereof, the cam-follower member of the sheet-supply unit 6 is guided by the secondary cam surface 44 of the second cassette 30, so that the sheet-supply arm 6*a* is first pivoted upward and then pivoted downward. Thus, the sheet-supply roller 6*b* can contact the uppermost one of the recording sheets P1 stacked on the bottom surface 30*a* of the second sheet-supply cassette 30. On the other hand, if the second cassette 30 is retracted from the sheet-supply position thereof to the non-sheet-supply position thereof, the cam-follower member is guided by the secondary cam surface 44, so that the sheet-supply arm 6*a* is first pivoted upward and then pivoted downward. Thus, the sheet-supply roller 6*b* can contact the uppermost one of the recording sheets P stacked on the bottom surface 3*b* of the first cassette 3, without interfering with the recording sheets P1 stacked in the second sheet-supply cassette 30.

Next, there will be described respective constructions of the inclined sheet-separate plate 8 (i.e., the inclined guide plate) and the sheet-separate body 8*a*. As shown in FIG. 6, the inclined sheet-separate plate 8 is provided in the rear end portion of the first sheet-supply cassette 3, such that the plate 8 extends in the Y direction parallel to the widthwise direction of the sheet-supply path 9. In addition, as shown in FIG. 9, the sheet-separate plate 8 has a height higher than the highest possible position that can be taken by the recording sheets P1 accommodated by the second sheet-supply cassette 30. That is, the inclined sheet-separate plate 8 and the sheet-separate body 8*a*, provided in the first sheet-supply cassette 3, are commonly used for separating the recording sheets P accommodated by the first sheet-supply cassette 3, and separating the recording sheets P1 accommodated by the second sheet-supply cassette 30.

The second sheet-supply cassette 30 is provided on the first sheet-supply cassette 3. Therefore, respective lower portions of the inclined sheet-separate plate 8 and the sheet-separate body 8*a* are used for separating the recording sheets P accommodated by the first cassette 3; and respective upper portions of the sheet-separate plate 8 and the sheet-separate body 8*a* are used for separating the recording sheets P1 accommodated by the second cassette 30. Thus, each recording sheet P that has been separated from the other recording sheets P by the cooperation of the lower portion of the sheet-separate body 8*a* and the sheet-supply roller 6*b*, is conveyed to the curved guide member defining the U-shaped portion of the sheet-convey path 9, after having passed by the respective upper portions of the sheet-separate plate 8 and the sheet-separate body 8*a* that correspond to the recording sheets P1 accommodated by the second cassette 30. On the other hand, each recording sheet P1 is conveyed along, and contacted with, the respective upper portions of the sheet-separate plate 8 the sheet-separate body 8*a* while being separated from the other recording sheets P1 by the cooperation of the upper portion of the sheet-separate body 8*a* and the sheet-supply roller 6*b*, and then is conveyed to the curved guide member.

An inner (or upper) surface 8*c* of the inclined sheet-separate plate 8 that is opposed to respective leading ends of the two sorts of recording sheets P, P1 is convexly curved such that a central portion of the inner surface 8*c* of the sheet-separate plate 8 with respect to the widthwise direction of each recording sheet P, P1, i.e., portions of the inner surface 8*c* that are near the sheet-separate body 8*a* project, from opposite end portions of the inner surface 8*c* with respect to the same direction, toward the respective leading ends of respective central portions of the recording sheets P, P1 with respect to the same direction. Since the inner surface 8*c* of the inclined sheet-separate plate 8 is a convexly curved surface, the leading end of widthwise central portion of the uppermost recording sheet P (or P1) is reliably contacted or engaged with the sheet-separate body 8*a* and is separated from the other recording sheets P (or P1) before respective leading ends of widthwise opposite end portions of the uppermost recording sheet P (or P1) are contacted or engaged with the inner surface 8*c* of the plate 8.

Figure 10:
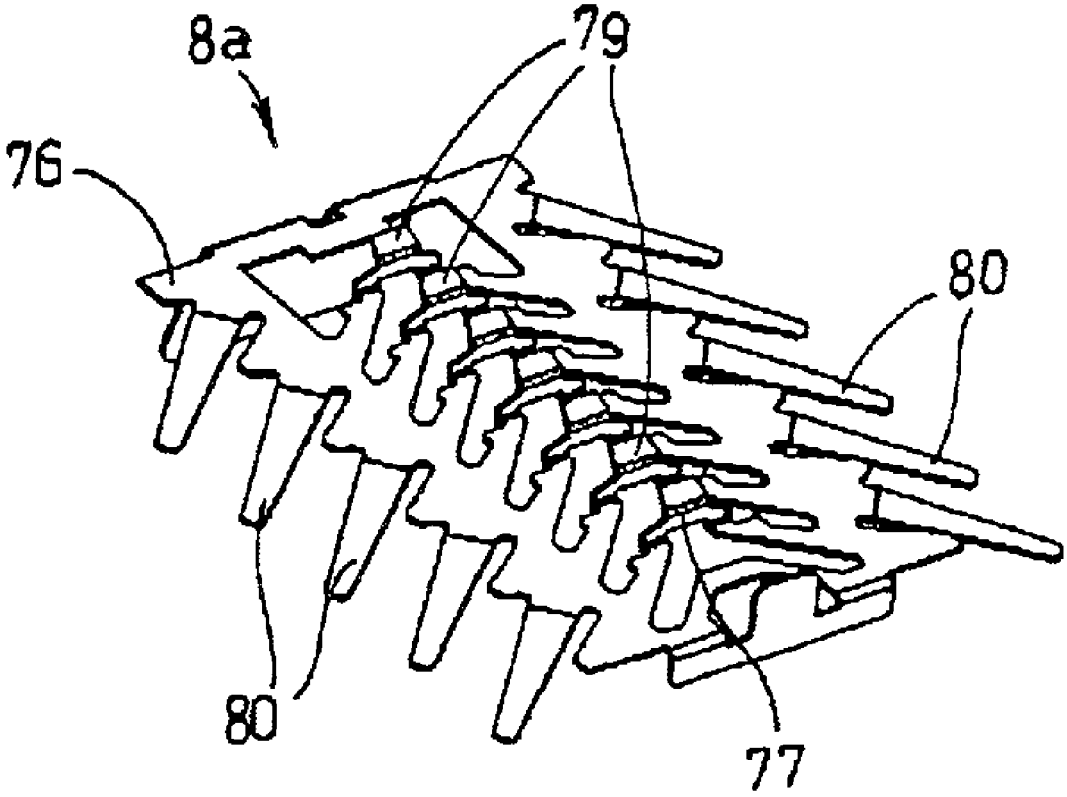
FIG. 10 is a perspective view of a sheet-separate body attached to an inclined sheet-separate (or guide) plate of the first sheet-supply cassette.
Figure 11A:
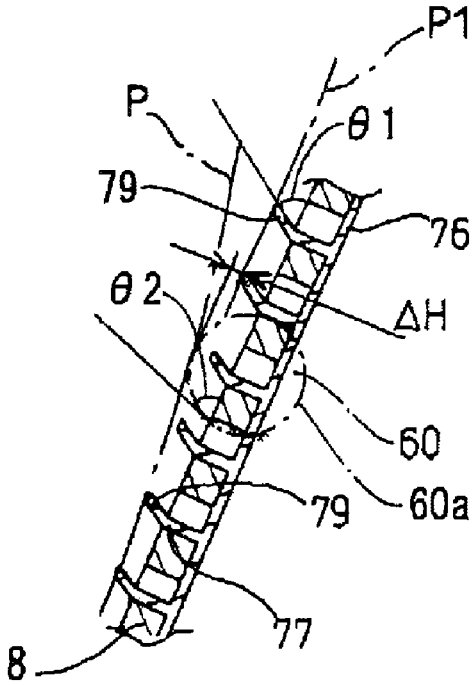
FIG. 11A is a longitudinal cross-section view showing a state in which the sheet-separate body is attached to the inclined sheet-separate plate; and F*ig*. 11B is a longitudinal cross-section view corresponding to FIG. 11A, and showing another sheet supplying apparatus in which another sheet-separate body is attached to another inclined sheet-separate plate.

As shown in FIGS. 6 and 10, the sheet-separate body 8*a* has a plurality of sheet-separate portions 79 that project toward the respective leading ends of the recording sheets P, P1 and that are arranged in an array along the sheet-supply path 9. The sheet-separate body 8*a* is constituted by an elongate elastic body (e.g., a metallic plate spring). The sheet-separate body 8*a* includes a flat base portion 76; and an array of arm portions 77 that are formed by cutting a plurality of inner portions of the base portion 86 and bending the cut inner portions upward. Each of the arm portions 77 has, as a free end portion thereof, the sheet-separate portion 79 that has a generally V-shaped cross section and that is inclined by an acute angle, θ1 (FIG. 11A), relative to a downstream direction of the sheet-supply path 9. In addition, the sheet-separate body 8*a* includes a plurality of elastic leg portions 80 that are formed along two long sides of the flat base portion 76 such that the elastic leg portions 80 are inclined in an upstream direction of the sheet-supply path 9. The elastic leg portions 80 cooperate with each other to apply an elastic force (or a biasing force) to the sheet-separate portions 79 via the base portion 76. As shown in FIG. 11A, the inclined sheet-separate plate 8 has, in the central portion thereof with respect to the Y direction, a plurality of window holes through which the arm portions 77 or sheet-separate portions 79 of the sheet-separate body 8*a*, attached to a back surface of the sheet-separate plate 8, project to the inner side of the same 8. When the leading end of each of the recording sheets P, P1 contacts at least one of the sheet-separate portions 79, at least one of the elastic leg portions 80 is elastically deformed to permit a portion of the base portion 76 to displace toward the one leg portion 80 and thereby cause the each sheet P, P1 to displace relative to the underlying sheet or sheets P, P1.

As shown in FIGS. 6 and 11A, the inclined sheet-separate plate 8 supports, at a height position corresponding to an intermediate portion of the array of sheet-separate portions 79 with respect to the sheet-supply path 9, two rollers 60 each as a rotatable member that assists the conveying of each recording sheet P (but not the conveying of each recording sheet P1). More specifically described, as shown in FIG. 11A, each of the two rollers 60 projects, by a distance, ΔH, in an inward direction from a plane tangential to the respective free ends of the sheet-separate portions 79. Preferably, the distance ΔH ranges from 0.5 mm, inclusive, to 1.0 mm, inclusive. In addition, as shown in FIG. 5, the two rollers 60 are provided at a height position where the rollers 60 can engage all the recording sheets P (from the bottom one to the top one) accommodated by the first sheet-supply cassette 3 but cannot engage any of the recording sheets P1 (even the bottom one) accommodated by the second sheet-supply cassette 30. That is, the two rollers 60 are provided at the substantially same height position as the height position where the bottom plate (i.e., the bottom surface 30*a*) of the second cassette 30 is located. Thus, only each recording sheet P supplied by the first cassette 3 is contacted or engaged with the rollers 60, so that the each recording sheet P is conveyed forward while being prevented from being contacted or engaged with downstream sheet-separate portions 79 that are located on a downstream side of the rollers 60 with respect to the sheet-supply path 9. Each of the rollers 60 has a cylindrical outer surface 60*a* a portion of which projects inward from the inner surface 8*c* of the inclined sheet-separate plate 8 such that a plane tangential to an upstream-side end of the projecting portion of the cylindrical outer surface 60*a* with respect to the sheet-supply path 9 is inclined by an acute angle, θ2, relative to the downstream direction of the sheet-supply path 9. Preferably, the projecting portion of the cylindrical outer surface 60*a* is less than 50% of the entire cylindrical outer surface 60*a*.

In the present embodiment, as shown in FIG. 6, the sheet-separate portions 79 are continually arranged at substantially regular intervals of distance along the sheet-supply path 9, and the two rollers 60 are provided, on either side of the arranged sheet-separate portions 79, at respective positions that are symmetric with each other with respect to the array of portions 79 with respect to the widthwise direction of each recording sheet P, P1. Thus, each recording sheet P, P1 is engaged, with well balanced forces, with the two rollers 60. However, the positions where the rollers 60 are provided, and/or the total number of the rollers 60 may be changed.

Figure 11B:
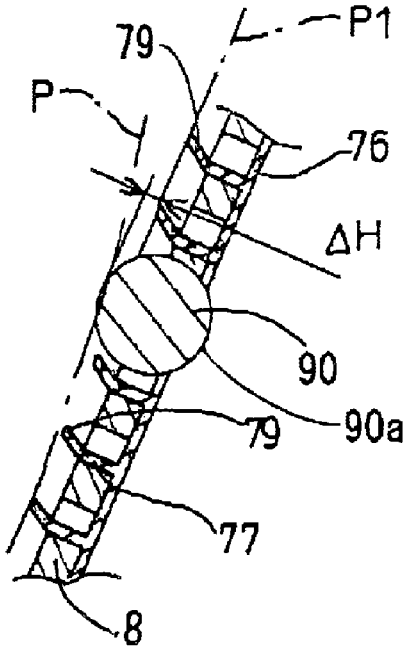

FIG. 11B shows a second embodiment of the present invention in which an array of sheet-separate portions 79 include upstream sheet-separate portions 79 corresponding to the recording sheets P accommodated by the first sheet-supply cassette 3, and downstream sheet-separate portions 79 corresponding to the recording sheets P1 accommodated by the second sheet-supply cassette 30, and a single roller 90 having a cylindrical outer surface 90*a* is provided in an increased space provided between the upstream sheet-separate portions 79 and the downstream sheet-separate portions 79 along the sheet-supply path 9. Like the rollers 60 shown in *Fig*. 11A, the roller 90 projects, by the distance, ΔH, in an inward direction from a plane tangential to the respective free ends of all the sheet-separate portions 79. In this case, each recording sheet P can reliably contact or engage, at the widthwise central portion thereof, the roller 90 supported by the central portion of the inclined sheet-separate plate 8.

In each of the above-described embodiments, in the state in which the second sheet-supply cassette 30 is retracted to, and kept at, the non-sheet-supply position thereof the sheet-supply roller 6*b* contacts the uppermost one of the recording sheets P accommodated by the first sheet-supply cassette 3 and, when the sheet-supply roller 6*b* is driven or rotated, one or more upper recording sheets P including the uppermost recording sheet P is or are conveyed toward the sheet-separate body 8*a*. In the case where two or more upper sheets P including the uppermost sheet P are conveyed toward the sheet-separate body 8*a*, the leading end of the uppermost sheet P is engaged with the sheet-separate body 8*a* and is thereby separated from the other, underlying sheet or sheets P. The thus separated uppermost sheet P is conveyed downstream so that the leading end of the uppermost sheet P is then contacted with the rollers 60 or the roller 90. Since the rollers 60 or the roller 90 project or projects, by the distance ΔH, inward from the sheet-separate portions 79*a*, 79*b* toward the recording sheets P. Therefore, after each recording sheet P is contacted with the rollers 60 or the roller 90, the each sheet P is conveyed downstream while being prevented from being engaged with the downstream sheet-separate portions 79 that are located on the downstream side of the rollers 60 or the roller 90, i.e., while being kept away from the downstream portions 79.

Meanwhile, in the state in which the second sheet-supply cassette 30 is advanced to, and kept at, the sheet-supply position thereof, the sheet-supply roller 6*b* contacts the uppermost one of the recording sheets P1 accommodated by the second sheet-supply cassette 30 and, when the sheet-supply roller 6*b* is rotated, one or more upper recording sheets P1 including the uppermost recording sheet P1 is or are conveyed toward the sheet-separate body 8*a*. In the case where two or more upper sheets P1 including the uppermost sheet P1 are conveyed toward the sheet-separate body 8*a*, the leading end of the uppermost sheet P1 is engaged with the sheet-separate body 8*a* and is thereby separated from the other, underlying sheet or sheets P1. Thus, the separated uppermost sheet P1 is conveyed downstream, without being contacted with the rollers 60 or the roller 90, Therefore, each of the recording sheets P1 accommodated by the second sheet-supply cassette 30 is reliably contacted or engaged with the downstream sheet-separate portions 79 that are located on the downstream side of the rollers 60 or the roller 90, and is thereby separated from the underlying sheet or sheets P1.

Unless the rollers 60 or the roller 90 are or is provided, each recording sheet P supplied from the first sheet-supply cassette 3 and separated from the other recording sheets P by the upstream sheet-separate portions 79, is unnecessarily contacted with the downstream sheet-separate top portions 79 provided for separating the recording sheets P1 accommodated by the second sheet-supply cassette 30. This leads to increasing a load or a force to convey each recording sheet P. However, according to the present invention, the rollers 60 or the roller 90 are or is employed, and each recording sheet P supplied from the first sheet-supply cassette 3 and separated from the other recording sheets P is effectively prevented by the same 60, 90 from being contacted with the downstream sheet-separate portions 79 that are located on the downstream side of the same 60, 90. Therefore, the sheet-conveying load or force is not unnecessarily increased. This leads to decreasing the driving power applied to the sheet-supply roller 6*b* used to supply each recording sheet P, and thereby decreasing the size or capacity of the driving motor to drive or rotate the roller 6*b*. Thus, the sheet supplying apparatus can be produced at a decreased cost and can be disposed in a decreased space.

It is to be understood that the present invention may be embodied with various changes, modifications, and improvements that may occur to a person skilled in the art without departing from the spirit and scope of the invention defined in the appended claims.

What is claimed is:

1. A sheet supplying apparatus for supplying a plurality of recording sheets, one by one, along a sheet-supply path, the apparatus comprising:

a first accommodating portion which has a first supporting surface, which accommodates a plurality of first recording sheets stacked on each other on the first supporting surface, and from which the first recording sheets are supplied, one by one, along the sheet-supply path;

a second accommodating portion which has a second supporting surface, which accommodates a plurality of second recording sheets stacked on each other on the second supporting surface, and from which the second recording sheets are supplied, one by one, along the sheet-supply path;

at least one supplying member which contacts an uppermost one of the first recording sheets accommodated by the first accommodating portion, so as to supply the uppermost first recording sheet from the first accommodating portion, and additionally contacts an uppermost one of the second recording sheets accommodated by the second accommodating portion, so as to supply the uppermost second recording sheet from the second accommodating portion;

a separating device which cooperates with said at least one supplying member to separate the first recording sheets from each other and separate the second recording sheets from each other, wherein the separating device includes (A) an inclined guide plate which is provided at an upstream-side end portion of the sheet-supply path such that the inclined guide plate extends in a widthwise direction of the sheet-supply path, which is inclined relative to each of the first and second supporting surfaces such that the inclined guide plate is opposed to respective leading ends of respective greatest possible numbers of the first and second recording sheets that can be accommodated by the first and second accommodating portions, and which guides a movement of each of the first and second recording sheets along the sheet-supply path, and (B) a sheet-separate body which is supported by the inclined guide plate and which includes a plurality of sheet-separate portions arranged in at least one array along the sheet-supply path such that the sheet-separate portions project from the inclined guide plate toward the first and second recording sheets accommodated by the first and second accommodating portions; and at least one contact preventing portion which projects toward the first and second recording sheets, beyond respective free ends of the sheet-separate portions, and which is provided at a position corresponding to an intermediate portion of said at least one array of sheet-separate portions with respect to the sheet-supply path, and assuring that said at least one contact preventing portion prevents each of the first recording sheets supplied from the first accommodating portion, from contacting at least one sheet-separate portion of a downstream portion of said at least one array of sheet-separate portions that is located on a downstream side of said at least one contact preventing portion with respect to the sheet-supply path, and allows each of the second recording sheets supplied from the second accommodating portion, to contact the downstream portion of said at least one array of sheet-separate portions.

2. The sheet supplying apparatus according to claim 1, wherein said at least one contact preventing portion comprises at least one rotatable member which is rotatable about an axis line parallel to the widthwise direction of the sheet-supply path, and which has a curved outer surface which is partially exposed in the sheet-supply path such that a plane tangential to an upstream-side end of the curved outer surface with respect to the sheet-supply path is inclined by an acute angle relative to a downstream direction of the sheet-supply path.

3. The sheet supplying apparatus according to claim 2, comprising a plurality of said rotatable members which are provided, with respect to the widthwise direction of the sheet-supply path, on either side of the intermediate portion of said at least one array of sheet-separate portions.

4. The sheet supplying apparatus according to claim 2, wherein said at least one rotatable member is provided in the intermediate portion of said at least one array of sheet-separate portions, so as to divide said at least one array of sheet-separate portions into the downstream portion thereof and an upstream portion thereof.

5. The sheet supplying apparatus according to claim 2, wherein said at least one rotatable member comprises at least one roller which is rotatable about the axis line parallel to the widthwise direction of the sheet-supply path, and which has, as the curved outer surface thereof, a cylindrical outer surface less than 50% of which is exposed in the sheet-supply path.

6. The sheet supplying apparatus according to claim 1, wherein said at least one contact preventing portion projects beyond a plane tangential to the respective free ends of the sheet-separate portions by not less than 0.5 mm and not more than 1.0 mm.

7. The sheet supplying apparatus according to claim 1, wherein the second accommodating portion is selectively movable, relative to the first accommodating portion, to an advanced position thereof where the second recording sheets are supplied, one by one, to the sheet-supply path, and to a retracted position thereof where the second recording sheets are not supplied.

8. The sheet supplying apparatus according to claim 7, wherein said at least one supplying member comprises a common supplying member which contacts, when the second accommodating portion is positioned at the retracted position thereof the uppermost first recording sheet accommodated by the first accommodating portion, and contacts, when the second accommodating portion is positioned at the advanced position thereof, the uppermost second recording sheet accommodated by the second accommodating portion.

9. The sheet supplying apparatus according to claim 1, wherein said at least one supplying member comprises at least one driven roller which is driven by a drive source to rotate about an axis line parallel to a widthwise direction of each of the first and second supporting surfaces.

10. The sheet supplying apparatus according to claim 1, further comprising a housing, wherein at least one of the first accommodating portion and the second accommodating portion comprises a sheet-supply cassette which is insertable into, and removable from, the housing.

11. The sheet supplying apparatus according to claim 1, wherein the sheet-separate body comprises a metallic sheet including a flat base portion; the plurality of sheet-separate portions which extend from the base portion such that each of the sheet-separate portions is inclined by an acute angle relative to a downstream direction of the sheet-supply path; and a plurality of elastic portions which extend from the base portion on one of opposite sides thereof that is opposite to an other side thereof on which the sheet-separate portions extend from the base portion, and wherein when the leading end of each of the first and second recording sheets contacts at least one of the sheet-separate portions, at least one of the elastic portions is elastically deformed to permit a portion of the base portion to displace toward said at least one elastic portion and thereby permit said each recording sheet to be separated from the other recording sheets.

12. The sheet supplying apparatus according to claim 1, wherein the inclined guide plate has a curved guide surface which guides the movement of said each of the first and second recording sheets and which is curved such that a central portion thereof with respect to the widthwise direction of the sheet-supply path is nearer to the respective leading ends of the first and second recording sheets than respective opposite end portions of the curved guide surface with respect to the widthwise direction of the sheet-supply path, and wherein the sheet-separate body is supported by a central portion of the inclined guide plate that has the central portion of the curved guide surface.

13. The sheet supplying apparatus according to claim 1, wherein the first accommodating portion comprises a first sheet-supply cassette which is attachable to, and detachable from, the apparatus and which has a first bottom surface as the first supporting surface, wherein the second accommodating portion comprises a second sheet-supply cassette which is supported by the first sheet-supply cassette such that the second sheet-supply cassette is selectively movable, relative to the first sheet-supply cassette, to an advanced position thereof near to the sheet-supply path and a retracted position thereof away from the sheet-supply path, and which has a second bottom surface as the second supporting surface, wherein said at least one supplying member comprises a common sheet-supply roller which commonly contacts and supplies the uppermost first recording sheet and the uppermost second recording sheet, and wherein said at least one contact preventing portion comprises at least one rotatable member which is supported by a portion of the inclined guide plate that corresponds to the intermediate portion of said at least one array of sheet-separate portions.

14. A recording apparatus, comprising:

the sheet supplying apparatus according to claim 1; and a recording device which records an image on said each of the first and second recording sheets supplied thereto by the sheet supplying apparatus.

15. The recording apparatus according to claim 14, wherein the recording device comprises an ink-jet recording head which ejects droplets of ink toward said each of the first and second recording sheets and thereby records the image thereon.

* * * * *